US010854349B2

(12) United States Patent
Conard

(10) Patent No.: US 10,854,349 B2
(45) Date of Patent: Dec. 1, 2020

(54) CONTAINER, METHOD FOR OBTAINING SAME AND TARGET ASSEMBLY FOR THE PRODUCTION OF RADIOISOTOPES USING SUCH A CONTAINER

(71) Applicant: NANOMARKER SPRL, Dion-Valmont (BE)

(72) Inventor: Milo Conard, Dion-Valmont (BE)

(73) Assignee: NANOMARKER SPRL, Dion-Valmont (BE)

( * ) Notice: Subject to any disclaimer, the term of this patent is extended or adjusted under 35 U.S.C. 154(b) by 649 days.

(21) Appl. No.: 15/325,014

(22) PCT Filed: Jul. 9, 2015

(86) PCT No.: PCT/EP2015/065687
§ 371 (c)(1),
(2) Date: Jan. 9, 2017

(87) PCT Pub. No.: WO2016/005492
PCT Pub. Date: Jan. 14, 2016

(65) Prior Publication Data

US 2017/0213614 A1 Jul. 27, 2017

(30) Foreign Application Priority Data

Jul. 10, 2014 (BE) ..... 2014/0551

(51) Int. Cl.
*G21K 5/08* (2006.01)
*G21G 1/10* (2006.01)
(Continued)

(52) U.S. Cl.
CPC ..... *G21K 5/08* (2013.01); *C25D 1/003* (2013.01); *G21G 1/10* (2013.01); *H05H 6/00* (2013.01);
(Continued)

(58) Field of Classification Search
CPC ..... G21K 5/08; H05H 6/00
See application file for complete search history.

(56) References Cited

U.S. PATENT DOCUMENTS 3,940,617 A * 2/1976 Famum ..... G01N 23/22 250/303
3,971,697 A 7/1976 Blue
(Continued)

FOREIGN PATENT DOCUMENTS

WO 2016005492 1/2016

OTHER PUBLICATIONS

International Searching Authority, "Search Report", issued in connection with International PCT patent application No. PCT/EP2015/065687, dated Sep. 21, 2015, 5 pages.
(Continued)

*Primary Examiner* — Lily C Garner
(74) *Attorney, Agent, or Firm* — Hanley, Flight and Zimmerman, LLC

(57) ABSTRACT

The invention relates to a container (100, 901, 902, 903, 904, 905, 906, 907, 908, 909, 910) for the production of radioisotopes by irradiation of a precursor material formed by a one-piece metal casing, the wall of said casing including one thin portion (130) having a thickness of between 5 and 100 μm, the remainder having a thickness greater than 100 μm. The invention also relates to a method for obtaining the container and to a target assembly using same.

10 Claims, 8 Drawing Sheets

(51) Int. Cl.

| | |
|---|---|
| ***H05H 6/00*** | (2006.01) |
| ***C25D 1/00*** | (2006.01) |
| ***H05H 13/00*** | (2006.01) |
| *G21G 1/00* | (2006.01) |

(52) U.S. Cl.
CPC ... *H05H 13/005* (2013.01); *G21G 2001/0015* (2013.01)

(56) References Cited

U.S. PATENT DOCUMENTS

| | | | | |
|---|---|---|---|---|
| 6,011,825 | A * | 1/2000 | Welch | G21G 1/10 376/195 |
| 7,787,584 | B2 * | 8/2010 | Park | G21C 3/3206 376/434 |
| 2005/0084055 | A1 | 4/2005 | Alvord et al. | |
| 2010/0226472 | A1 * | 9/2010 | Pendley, II | G21C 3/06 376/416 |
| 2012/0027152 | A1 * | 2/2012 | Reese | G21G 1/02 376/190 |
| 2014/0010338 | A1 * | 1/2014 | Ehst | G21K 5/08 376/202 |

OTHER PUBLICATIONS

International Searching Authority, "Written Opinion", issued in connection with International PCT patent application No. PCT/EP2015/065687, dated Sep. 21, 2015, 5 pages. English translation not available.

European Patent Office, "Decision to Grant," issued in connection with European patent application No. 15736824.2, dated Mar. 22, 2018, 1 page. English version not available.

* cited by examiner

CONTAINER, METHOD FOR OBTAINING SAME AND TARGET ASSEMBLY FOR THE PRODUCTION OF RADIOISOTOPES USING SUCH A CONTAINER

RELATED APPLICATIONS

This patent is a nationalization of International Patent Application PCT/EP2015/065687, which was filed Jul. 9, 2015 and titled "Container, method for obtaining same and target assembly for the production of radioisotopes using such a container", which claims priority to Belgian Patent Application BE 2014/0551, which was filed on Jul. 10, 2014 and titled "Conteneur, son procédé d'obtention, et ensemble de cible pour la production de radio-isotopes utilisant un tel conteneur", both of which are hereby incorporated by reference in their entireties.

TECHNICAL FIELD

The invention relates to a container usable for producing radioisotopes, to a method allowing such a container to be obtained, and to a target assembly including such a container.

DESCRIPTION OF THE PRIOR ART

It is known to produce a radioisotope by irradiating a target containing a precursor of the radioisotope by means of a beam of particles. In particular, $^{18}F$ is produced by irradiating a target material containing $^{18}O$-enriched water with a beam of protons.

A particle accelerator, such as a cyclotron or a linac, is used to produce the beam of particles. When the precursor of the radioisotope is a liquid or a gas, the target includes a container including a chamber or cavity that is generally closed by a window that allows the beam to pass without being weakened substantially. This window must therefore be as thin as possible, but must withstand the mechanical and thermal stresses and the radiation to which it is subjected in operation. The power dissipated in the target during the irradiation by a beam of particles is given by the product of the energy of the particles by the current of the beam. This power may be very high. The target is generally cooled aggressively by means such as a flow of water.

In the case of use of a cyclotron, the target may be placed outside the cyclotron. This solution facilitates the construction of the target and allows easy access to the latter, especially by the cooling means. However, it requires that the beam be extracted from the accelerator, this presenting many difficulties. The various known extracting means, such as stripping, electrostatic or magnetic deflection and self-extraction each also has known difficulties. Extraction by stripping is relatively easy, but requires negative ions that are less stable during the acceleration, more difficult to produce and that require a higher vacuum. Deflectors in general include a septum and a high-voltage electrode that have the function of separating the last turn of the beam from the preceding turn. When the successive turns are closely spaced or overlap, a fraction of the beam strikes the septum, which heats up, is activated and may be damaged. However, once the beam has been extracted, it may be directed toward the target, and it is possible to control the size, the angle and the position of impact of the beam on the target.

Another solution consists in placing the target inside the cyclotron. It is then not necessary to extract the beam. The target is placed in the peripheral region of the median plane of the cyclotron. The beam, which traces almost circular orbits of increasing radii, has a certain width and each turn is separated from the preceding turn by a certain distance. This distance may be small, to the point that the beam forms a sort of continuous sheet in the median plane of the cyclotron. A fraction of the beam or of the sheet, which fraction is located radially towards the exterior, then strikes the target, whereas the fraction of the beam or of the sheet that is located radially toward the interior continues to trace its path through the machine. This technique is widely used and with success in the case of solid targets.

Document WO 2013049809 discloses a target assembly for producing radioisotopes for the synthesis of radiopharmaceutical products from a liquid precursor. The target, which is shown in FIG. 1, comprises a container 10 including a chamber 12 able to contain a precursor material of the desired radioisotope. A thin covering sheet 14 made of a material that is permeable to the beam covers the chamber and is secured to the container so as to seal the chamber by means of a front clamping flange 16 and a back clamping flange 18. A channel 24 allows access to the chamber 12 for filling or emptying the precursor material. Other securing methods may be envisioned, such as soldering, welding or brazing. The point O represents the center of the cyclotron and the arrow A a beam of particles tracing a turn or an orbit of smaller radius than the radial position of the target. This beam will continue to trace its path through the cyclotron, and reappear with an increased energy and a larger radius. The arrow B represents a more exterior turn, tangentially striking the covering sheet of the target. Some of this beam does not interact with the precursor contained in the chamber, but with the covering sheet 14, thus losing its energy without producing a useful effect. The arrow C represents an even more exterior turn, which penetrates into the chamber 12 and interacts therein with the precursor of the radioisotope that it contains. It may be seen that there is an optimal orientation for the target assembly, minimizing the fraction of beam lost in the tangential edge of the window 14. This implies a precise and therefore difficultly reproducible adjustment of the orientation of the target during each intervention. The assemblage of this target, in particular of the covering sheet, is tricky and the resulting assembly is fragile. When such a covering sheet must be replaced, a technician must intervene on a piece of equipment that has been activated during the irradiation, this requiring time be spent waiting for the radioactivity to decrease. The chamber for the flow of cooling water 20, which is supplied by the tube 22, is placed in thermal contact with the back portion of the chamber 12. The cooling can therefore only be imperfect.

Zeisler et al. (Applied Radiation and Isotopes, vol. 53, 2000, pages 449-453) have constructed a spherical target made of niobium in which the beam of particles strikes a first window, consisting of a sheet of aluminum of 0.3 mm thickness, then a layer of cooling water, of 1.1 mm thickness, and lastly the wall of the container, which has the shape of a sphere. This sphere was obtained by welding two hemispheres, themselves obtained by stamping circular blanks made of niobium, of 0.25 mm thickness. Unlike generally known targets, the container of this target does not contain a thin window for the penetration of the beam. The container must on the one hand mechanically resist the pressures that may be generated during the irradiation, and on the other hand be sufficiently thin to decrease the loss of energy of beam. The spherical shape chosen is that which gives the best resistance to pressure, the stresses being uniformly distributed. However, the thickness required to allow the two tubes and two hemispheres to be welded and formed means that the beam loses a significant portion of its energy as it passes therethrough, this producing heat, and meaning that additional cooling of the zone of penetration of the beam is required.

This additional cooling is achieved by a flow of water and hence the aluminum window and the layer of water are required, which in turn cause a loss of energy and the production of heat. Because of the need for additional cooling, this target is not suitable for use as an internal target. This target requires a relatively high proton energy (19 MeV) if a significant amount of $^{18}F$ is to be produced because the loss of energy of these protons in the cooling system and the wall of the container is about 8 MeV.

SUMMARY OF THE INVENTION

One aim of the invention is to provide a container able to be used for the production of radioisotopes, a method for obtaining such a container, and a target assembly including such a container, that is reliable, easy to assemble and use, and that has a very good transparency to the beam of particles. The invention is defined by the independent claims. The dependent claims define preferred embodiments of the invention.

According to a first aspect of the invention, a container is provided for producing radioisotopes by irradiation of a precursor material. According to the invention, the container consists of a metal jacket of integral construction, the wall of said jacket having a thin fraction, of a thickness comprised between 5 and 100 μm, the rest having a thickness larger than 100 μm.

In one preferred embodiment, said jacket has a symmetry of revolution, said thin fraction extending over a fraction of the height of the jacket.

The container may include at least one end having a conical shape, the base of the cone being oriented toward the exterior of the container.

One end of said jacket may be closed.

The thin fraction may have an outside diameter comprised between 4 mm and 100 mm.

the container may be at least partially made from at least one metal selected from nickel, titanium, niobium, tantalum and the stainless steels. Alloys such as Havar®, Invar® and Kovar® are also preferred. Alloys having a low thermal expansion coefficient are advantageous in the case of rotating targets.

According to a second aspect of the invention, a method is provided for obtaining a container according to the invention, which includes the steps of:

providing a matrix;

electrodepositing on the matrix a thickness of a metallic material, until a first thickness comprised between 5 μm and 100 μm is obtained;

masking a fraction of the surface of said matrix;

electrodepositing on the unmasked section until a thickness larger than 100 μm is obtained;

removing the matrix.

The matrix may advantageously be removed by dissolution.

According to a third aspect of the invention, a target assembly is provided for producing radioisotopes, including a container according to the invention, and including a holding tube including at one end a threaded portion, and a ring including a suitable interior thread, the holding tube and the ring being configured to encase the container.

When the container has an end of conical shape, the holding tube may then advantageously have a conical end congruent with the end of the container, and the ring may advantageously have a conical end congruent with the end of the container.

According to one preferred embodiment of the invention, the holding tube and the container are mounted so as to be able to rotate about an axis and the target assembly includes a motor arranged to make the holding tube and the container rotate.

The target assembly may include a cooling tube placed inside the container and arranged to allow a cooling liquid to flow.

Preferably, the cooling tube may include, at its lower end, a cooling head, which may have on a portion of its periphery liable to receive the beam, a recess, which gives to the incident beam a longer path in a precursor liquid.

The target assembly according to the invention may be used as an internal target in a cyclotron or as an external target. It may also be used as a beam stop.

DETAILED DESCRIPTION OF THE INVENTION

Figure 1:
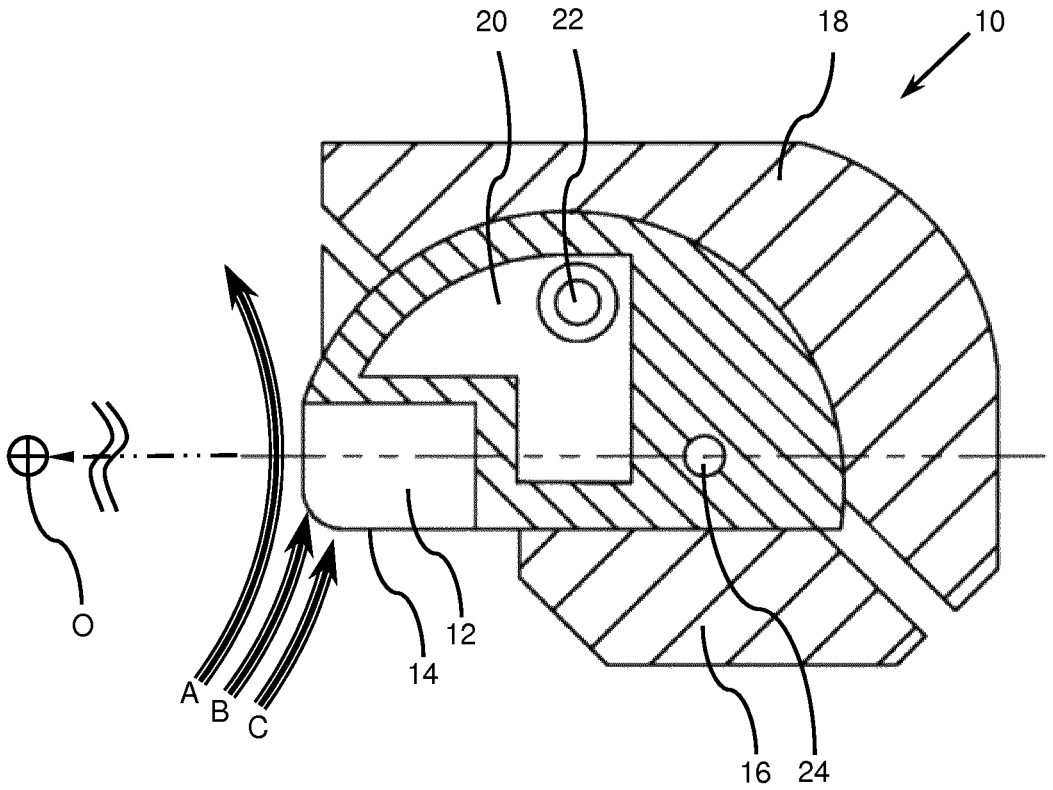
FIG. 1 is a cross-sectional view of a prior-art container, namely that of WO2013049809.

FIG. 1 is a cross-sectional view of a prior-art container, namely that of WO2013049809, and was described above.

Figure 2:
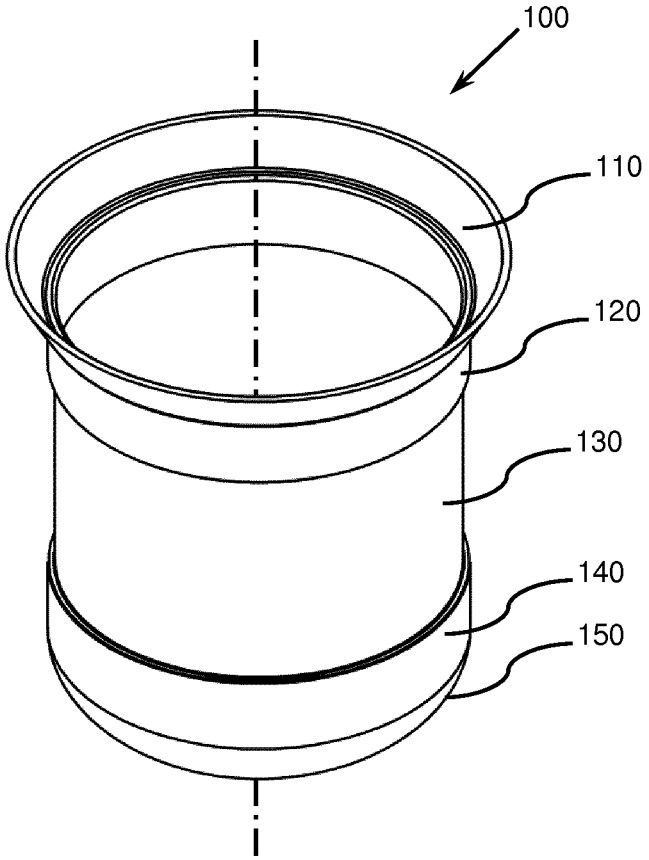
FIG. 2 is a semi-isometric perspective view of a container according to the invention.

FIG. 2 is a semi-isometric perspective view of a container 100 according to the invention. This container 100 takes the form of a "thimble", having a symmetry of revolution about an axis. The upper portion 110 is open and may have a conical shape, the opening of the cone being oriented upward. As explained below, this arrangement is of benefit as regards the assemblage of the container 100 into a target assembly. The top of a first cylindrical portion 120 is connected to the upper portion 110 and its bottom is connected to a thin wall section 130. This thin wall section 130 is connected to a second cylindrical portion 140, that itself is connected to a dome 150 closing the container 100 at the bottom. The thickness of the thin fraction is smaller than or equal to 100 μm and for example 80, 60, 40, 20, 10 or even 5 μm. A smaller thickness gives a better transparency to the beam and therefore a better production yield, but is more fragile. The applicant has determined experimentally that the value of 20 μm is a good compromise between these contradictory requirements. The non-thinned portions, namely the open upper portion 110, the first 120 and second 140 cylindrical portion and the dome 150 are produced with a thickness larger than the thickness of the thin wall fraction 130. For example, when the thin fraction has a thickness of 20 μm, the non-thinned portions may have a thickness larger than or equal to 100 μm, 200 μm or more for example. The various portions of the container 100 connect to one another without sharp angles, such that a better mechanical resistance, especially to pressure, is obtained. The inside diameter may be about 10 mm and the total height 11 mm and the angle of the cone may be 30°. The container 100 shown has a cylindrical shape. However, it is possible, without departing from the scope of the present invention, to produce a container 100 having a more complex shape, with a curvature toward the interior, such as a one-sheet hyperboloid, or a bulging shape, such as a barrel. The container 100 has been shown with an upward-facing opening and a closed bottom side. However, it is possible to imagine, without departing from the scope of the invention, a container 100 having two openings such as shown. A container 100 that may be supplied with target material from above or below and through which a coolant fluid or fluid precursor may be made to flow from top to bottom is then obtained.

The obtainment of a container 100 according to the invention, in particular when the thin fraction 130 is very thin, presents many difficulties. The applicant has developed a manufacturing method by virtue of which the shape shown, or other shapes, may be produced easily. This method is based on electroforming:

- A matrix having the shape of the interior of the container 100 is produced. This matrix may for example be made of aluminum;
- A metal layer is deposited by electrodeposition on all the exterior surface of the matrix, until the thickness desired for the thin portion has been obtained;
- A fraction of the height of the matrix is masked by applying an insulating layer, a lacquer or a plastic tape for example;
- the electrodeposition is continued until the thickness desired for the non-thinned portions has been obtained;
- the matrix is removed, for example in a caustic solution.

The thickness of the deposit is determined by the magnitude of the current and the duration of application thereof. The following metals may be used: nickel, titanium, niobium and tantalum, and alloys may also be obtained such as stainless steel, Havar® (cobalt-based alloy), Invar® or Kovar®. In the case of a rotating target, the point of penetration of the beam into the container is a hotspot that is in continuous motion. This spot is a source of thermal expansion/contraction that may lead to fatigue of the metal. The choice of a material with a low thermal expansion coefficient, such as Invar® and Kovar®, may then be advantageous. It is also possible to deposit different alloys or metals in successive electrodeposition steps so as to obtain a first layer in one material, and one or more other layers in other materials. It is thus possible to choose the constituent material of the thin fraction for its resistance to the beam, or to make the layer making contact with the precursor material from a material having a chemical compatibility with the precursor material. Niobium may advantageously be used for the first layer forming the internal wall of the container i.e. the wall making contact with the precursor material. Specifically, it is known that the use of niobium does not lead to contamination of the produced radioisotope by undesired radioisotopes.

The choice of the thickness of the thin portion 130 is an important element of the invention. In the table below, the residual energy that a beam of protons having an energy of 7, 10, 15, 20 and 30 MeV, respectively, has after passage through a nickel sheet of various thicknesses has been indicated. It may be seen that when the sheet has a thickness of 5 μm, the energy loss of the protons is negligible i.e. less than 3% at 7 MeV and less than 0.2% at 30 MeV. In contrast, at 100 μm and low energy, the loss in the sheet is substantial. It is then necessary to make recourse to a higher energy and therefore a more expensive accelerator. It is known that the production yield of $^{18}F$ from $H_2{}^{18}O$ by (p,n) reaction is practically zero when the protons have an energy below 3 MeV. To obtain a yield higher than 60 mCi/μA, it is necessary to use protons of 6 MeV at least. The thickness values indicated in bold in the table below are therefore maximum preferred thicknesses, depending on the energy of the available beam. If a yield even higher than 60 mCi/μA is desired, it is necessary to further decrease the thickness of the thin fraction.

| NICKEL Sheet | Incident E <MeV> | | | | |
|---|---|---|---|---|---|
| thickness <μm> | 7 | 10 | 15 | 20 | 30 |
| | Transmitted E <MeV> | | | | |
| 5 | 6.84 | 9.87 | 14.91 | 19.92 | 29.94 |
| 10 | 6.67 | 9.74 | 14.81 | 19.85 | 29.89 |
| 20 | 6.32 | 9.48 | 14.62 | 19.70 | 29.78 |
| 40 | 5.59 | 8.95 | 14.24 | 19.39 | 29.55 |
| 60 | 4.77 | 8.38 | 13.85 | 19.07 | 29.33 |
| 80 | 3.86 | 7.80 | 13.43 | 18.76 | 29.10 |
| 100 | 2.75 | 7.16 | 13.01 | 18.44 | 28.86 |
| 200 | Stopped | 3.00 | 10.79 | 16.75 | 27.72 |

The choice of a thinner wall, for example of thickness smaller than or equal to 100 μm, allows the production of heat as the beam passes through to be limited. The above table may be used to guide the choice of the thickness when the chosen material is nickel. Other metals, such as niobium, titanium or Havar®, have a slightly higher transparency and will give better results.

Figure 3:
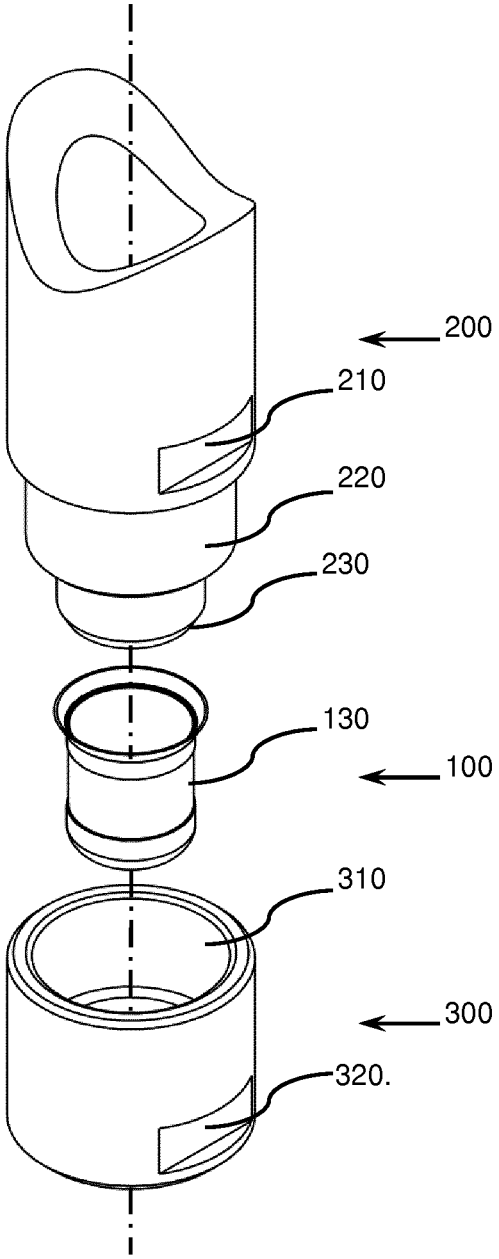
FIG. 3 is an exploded semi-isometric perspective view of the lower portion of a target assembly according to the invention.

FIG. 3 is an exploded semi-isometric perspective view of the lower portion of a target assembly according to the invention and shows how the container 100 is arranged in a holding tube 200. The tube has a male threaded portion 220. A ring 300 has a corresponding female threaded portion 310. The ring covers the upper portion 110 of the container 100 and presses it against the lower portion of the holding tube 200. At least the thin wall fraction 130 of the container 100 then emerges from the assembly thus formed. The holding tube 200 and the ring 300 may include flats 210, 320 that then allow an operator to assemble and disassemble the assembly very rapidly by means of two open-ended wrenches. The holding tube 200 and the ring 300 may for example be produced from stainless steel. Other mechanical assembling means may also be used without departing from the scope of the invention, such as quick-release hose clamps. In one preferred embodiment of the invention, the lower portion of the holding tube 200 includes a conical end 230 that is congruent with the conical portion 110 of the container 100, said conical portion itself being congruent with a conical end 330 of the ring 300. In this embodiment, an excellent seal tightness may be obtained without having to make recourse to a seal: the seal tightness is ensured by the metal-to-metal contact.

Figure 4:
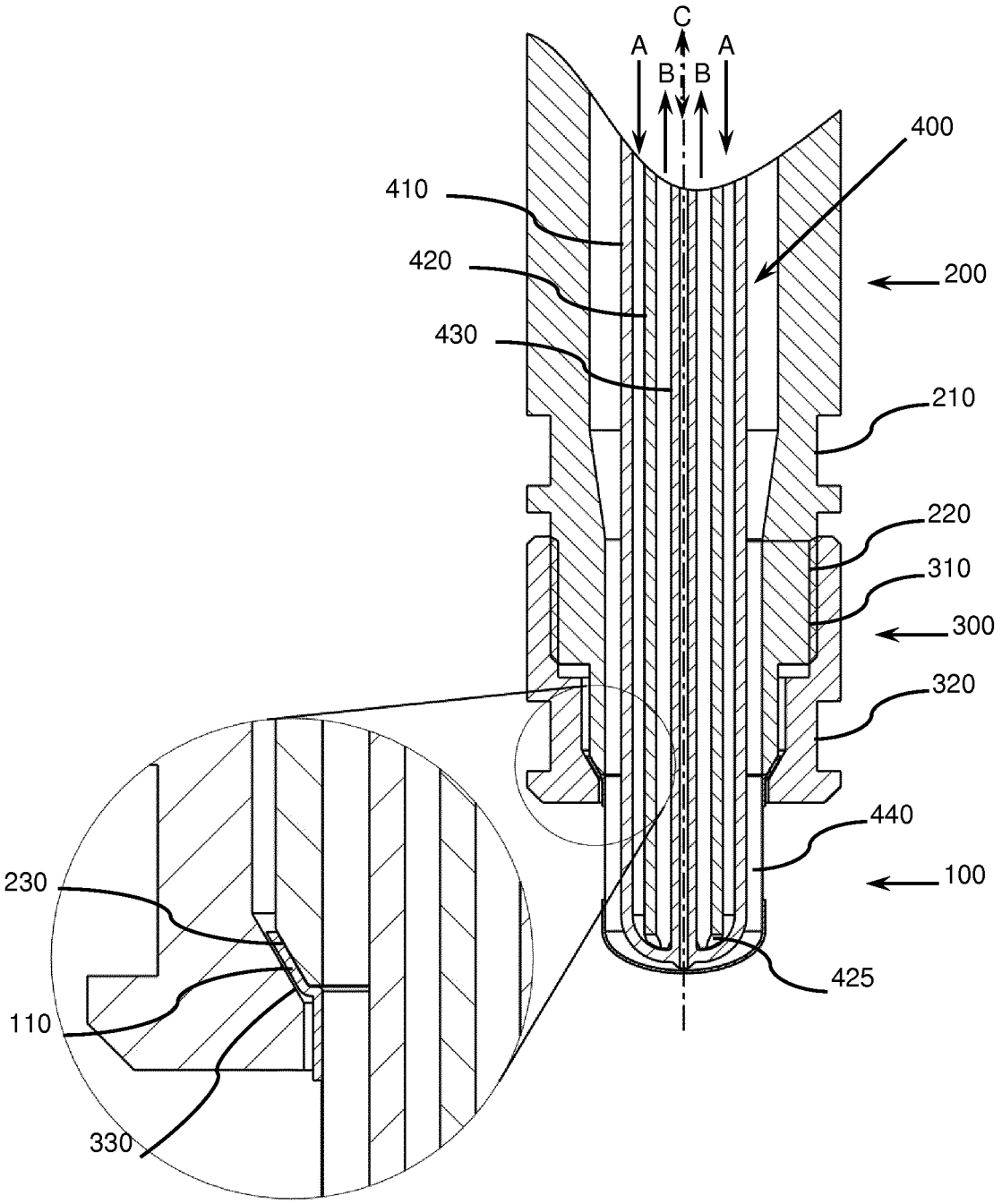
FIG. 4 is a cross-sectional view of the lower portion of a target assembly according to the invention.

FIG. 4 is a cross-sectional view of the lower portion of a target assembly according to the invention. Apart from the elements described above with reference to FIG. 3, the "pocket" assembly 400 is also shown, this pocket assembly playing the dual role of ensuring the cooling of the precursor material contained in the container and that cools in its turn the container, and of allowing the precursor material to be loaded into or unloaded from the container. A cooling tube 410 that is closed at its lower end may be inserted into the holding tube 200 and end in the container 100. In one exemplary embodiment, the container 100 has an inside diameter of 10 mm and a height of 10 mm and the cooling tube 410 an outside diameter of 8 mm, the irradiation chamber 440 having a useful volume of approximately 350 $mm^3$. An intermediate tube 420, which is open at its lower end 425, and of diameter smaller than that of the cooling tube, is inserted into the latter. It is thus possible to make a cooling liquid such as water flow through the space comprised between this cooling tube 410 and this interior tube 420. The arrows A represent the entrance of the cooling liquid and the arrows B the exit of the cooling liquid. The directions of flow A and B may be inverted. Since the heat transfer area is large and uniformly distributed, this arrangement allows excellent cooling to be obtained. In the case where the target assembly allows the assembly made up of the container 100, the holding tube 200 and the ring 300 to be rotated, the "pocket" assembly 400 remains stationary. The relative movement of these 2 assemblies produces a stirring effect that further improves the cooling by inducing a forced convection. A capillary tube 430 placed axially inside the intermediate tube 420 and sealably passing through the lower end of the cooling tube 410 in order to end in the space comprised between the container 100 and the cooling tube 410 allows the precursor material to be loaded and unloaded as indicated by the two-headed arrow C. The enlarged view shows how the conical portion 110 of the container is clamped between the conical end of the ring 330 and the conical end of the holding tube 230, thus ensuring the seal tightness without using a seal.

Figure 5:
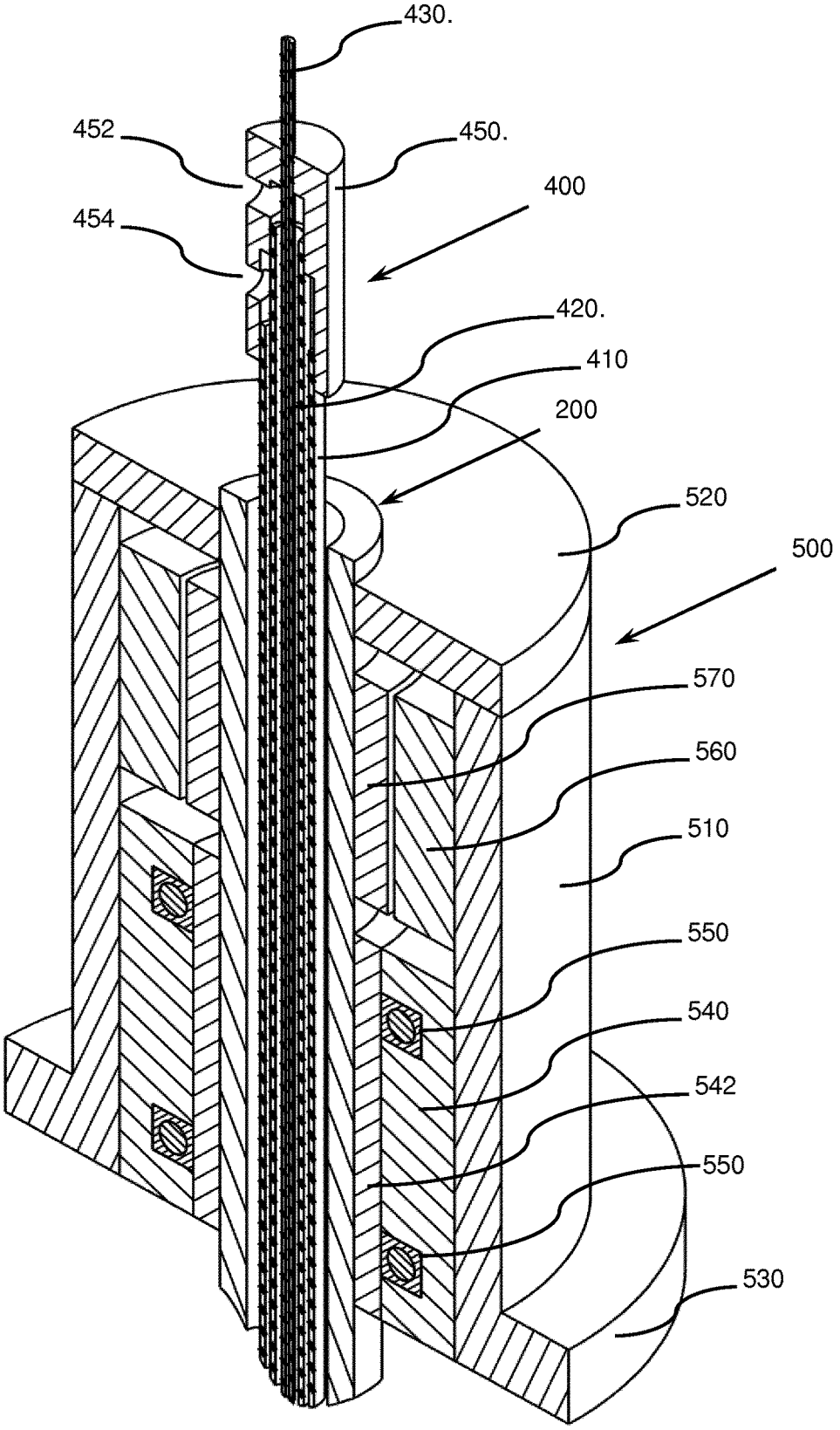
FIG. 5 is a perspective view of an axial cross section through the upper portion of a target assembly according to the invention, in an embodiment allowing the container to be rotated.

Independently of whether the target of the invention is used as an internal or external target, it is advantageous to be able to make it rotate. It is possible to either successively give thereto various orientations, for example to rotate it by 10° each time it is used, or preferably, to continuously rotate the container 100 during the irradiation. It is thus possible to ensure that all the periphery of the thin wall fraction is passed through by the beam, thereby ensuring a better distribution of the production of heat over a larger area. Furthermore, in the case of a liquid target, the rotation induces stirring of the precursor material, thereby improving the cooling by convection. FIG. 5 is a perspective view of an axial cross section through the upper portion 500 of a target assembly according to the invention, in one embodiment allowing the container 100 to be made to rotate. The container 100 (not shown in the figure) and the holding tube 200 are arranged in the rotor 570 of an electric motor. The stator 560 is secured to a housing 510 that is fixed. Maintenance and seal-tightness are ensured by a seal-bearing having a fixed portion 540 and a rotating portion 542. This seal-bearing may include ball bearings 550 and 550'. This seal may for example be a magnetic fluid seal such as those sold by Rigaku. The distributing head of the pocket 400 emerges from the upper portion of the target assembly and gives access to the orifices 452, 454 through which the cooling fluid respectively enters and exits. and to 430 through which the precursor material is filled/emptied. There may be two separate entrance and exit tubes.

Figures 6A, 6B, 6C:
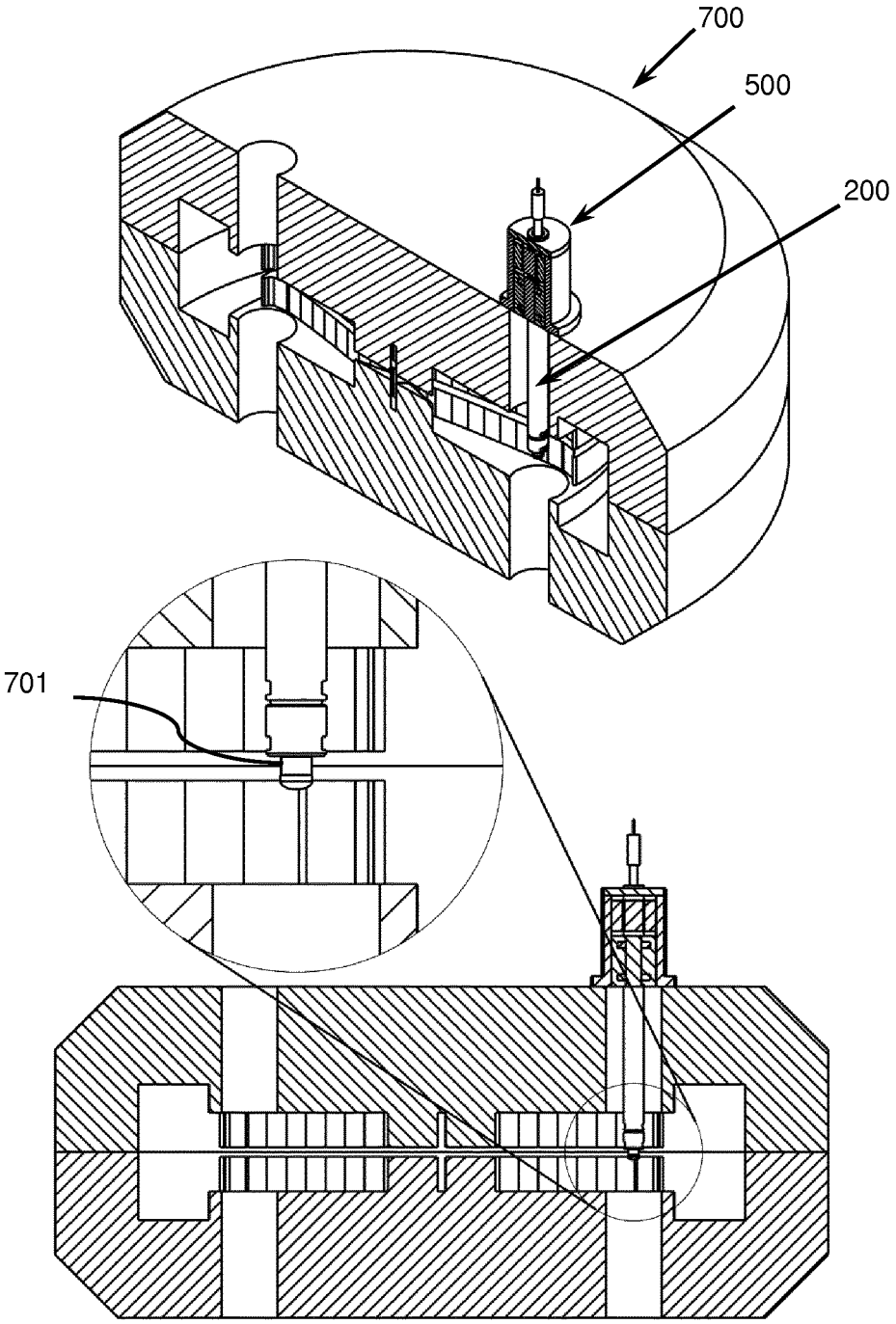
FIGS. 6*a*, 6*b* and 6*c* are a cross-sectional and semi-isometric perspective view, a cross-sectional view and a detailed view, respectively, of a cyclotron in which a target assembly according to the invention, with possibility of rotation, is arranged as an internal target.

FIGS. 6*a* and 6*b* show a cyclotron 700 in which a target assembly according to the invention is placed. The upper portion 500 emerges from the upper face of the cyclotron 700. The holding tube 200 has a length such that the container 701 is located in the median plane of the cyclotron, the thin fraction thereof being exposed to the beam, as shown in the detailed view 6*c*. When the target assembly of the invention is used as an external target, it may be placed at the end of the beamline and receive the beam radially. It is also possible to produce a container the thin portion of which is located on the base, such as in the containers 907 and 909 shown in FIG. 9, and to orient the beam toward this base, parallelly to the axis of symmetry of the container.

Figures 7A, 7B:
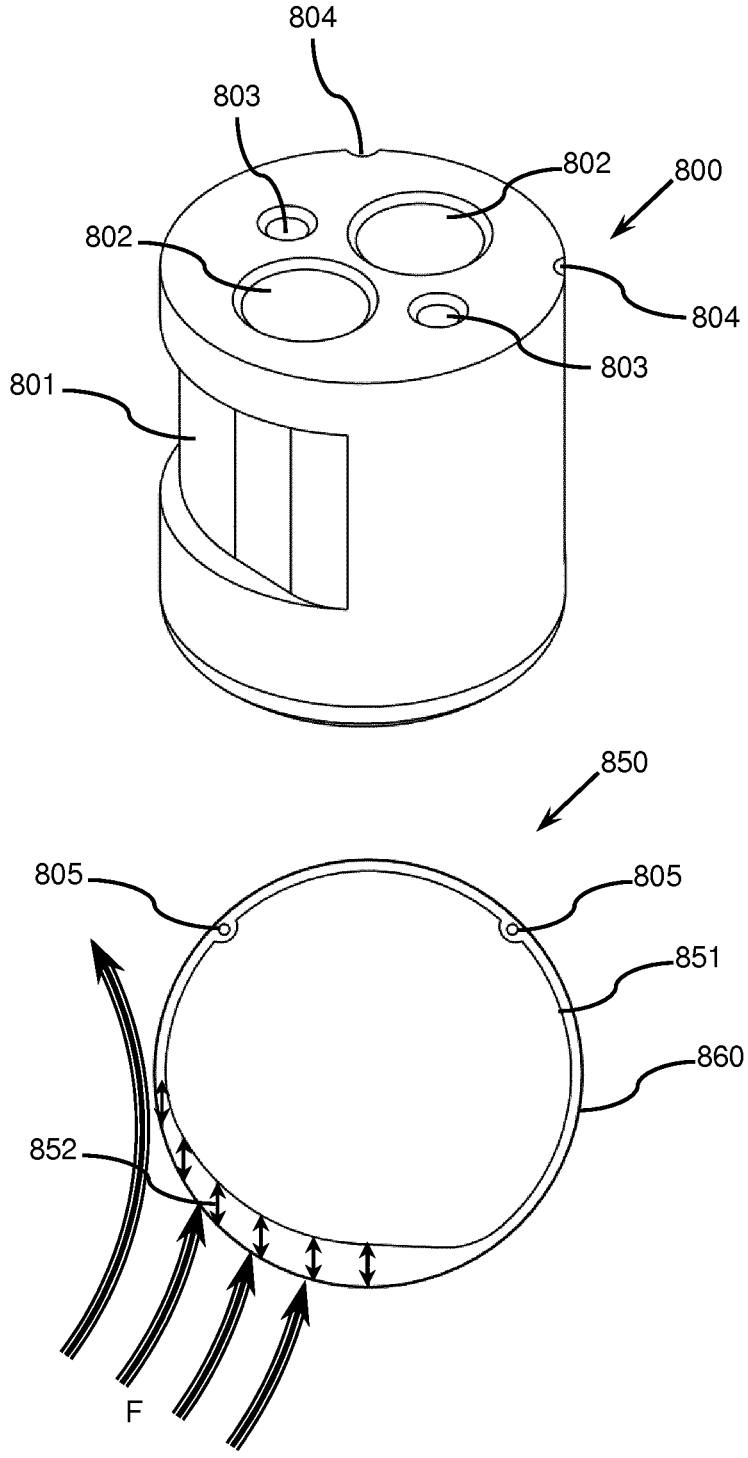
FIG. 7*a* is an isometric perspective view of the lower end of a cooling tube of a pocket according to one particular embodiment of the invention.
FIG. 7*b* is a top view of a cross section perpendicular to the axis of this tube in position in a container.
Figure 8:
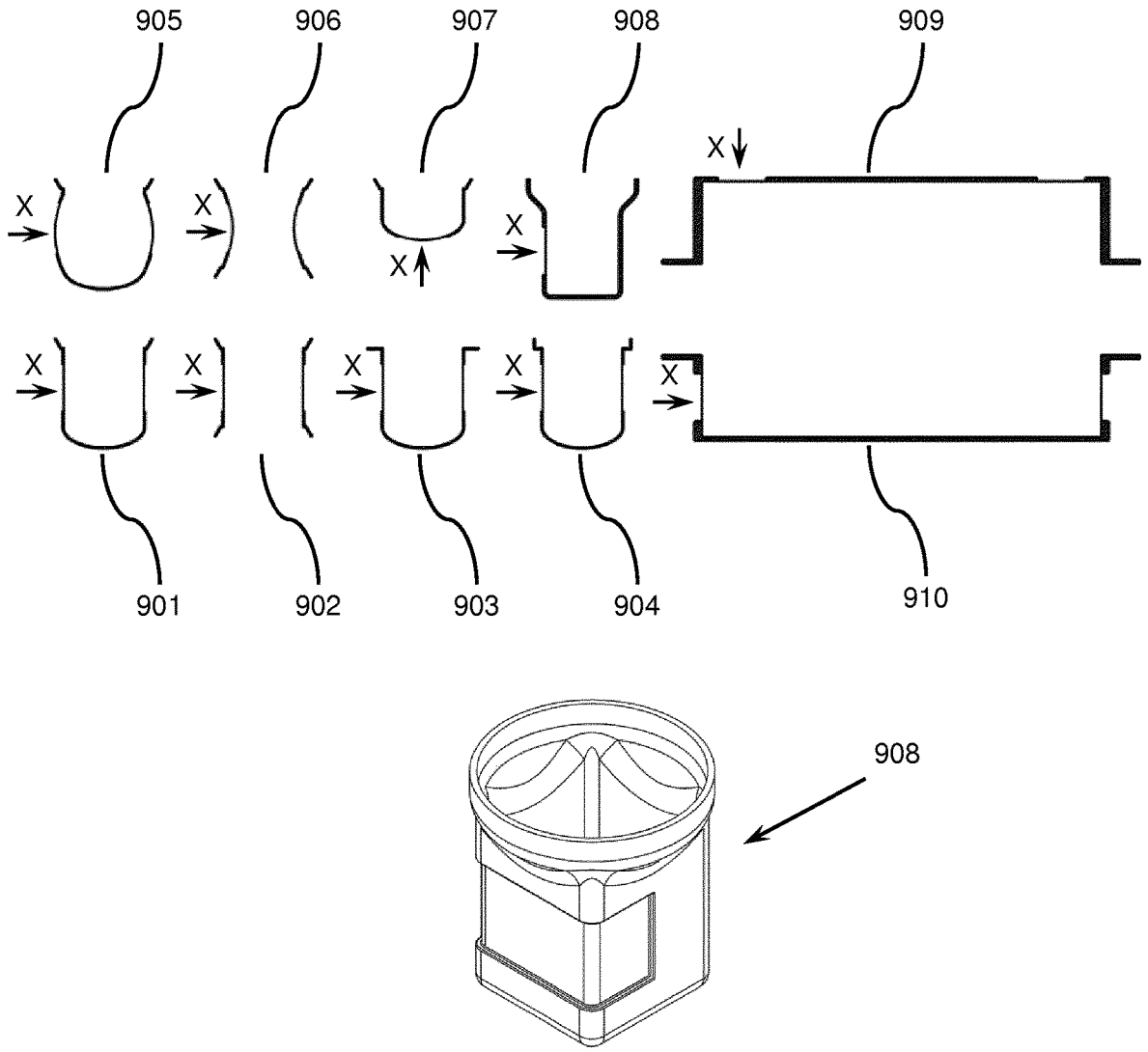
FIG. 8 shows cross-sectional views of a plurality of embodiments of containers according to the invention and a semi-isometric perspective view of one thereof.

Certain radioisotope precursors, such as $H_2{}^{18}O$, are precious and expensive. Moreover, it is sometimes advantageous to be able to synthesize radiochemicals from a concentrated product. It is therefore advantageous to minimize the amount used. To this end, a preferred embodiment of the invention has been designed, in which embodiment (shown in FIGS. 7*a* and 7*b*) the volume of the chamber is even smaller. FIG. 7*a* is a semi-isometric perspective view of the lower end of a cooling head 800 of a pocket of this preferred embodiment. This tube has a face 801 having an optimized profile as discussed below. The entrance/exit orifices 802 of the cooling liquid allow the cooling liquid to be made to flow through the interior of the cooling head 800. In this example, there are two parallel entrance and exit tubes, but there could be only a single one thereof as in the example in FIG. 4. The entrance/exit orifices 803 of the precursor liquid open below the lower end of the cooling head 800 and allow the space comprised between the container and the cooling head 800 to be accessed. Notches or grooves 804 may be provided for the placement of temperature probes, thermocouples for example. FIG. 7*b* is a top view of a cross section perpendicular to the axis of this cooling head 800 in position in a container 860. As may be seen from this cross section, the cooling head 800 has, on a portion of its periphery, a recess 851, which gives to the incident beam, represented by the arrows F, a longer path 852 in the precursor liquid, although the space between the cooling head 800 and the container 160 is smaller in the places where there is no incident beam. The length of this path is defined so that the beam can deposit all its useful energy in the precursor material. This arrangement has the following advantages: decrease of the necessary volume of precursor; maximization of cooling, due to a minimum thickness of liquid; use of all the useful energy (for example the energy higher than 4 MeV for protons in $H_2{}^{18}O$) of the particles of the beam in the precursor. The thermocouples 805 allow the temperature of the target to be controlled in real time. In the embodiment in which the target is rotated, the container 860 rotates whereas the cooling head 800 remain stationary, thereby promoting the stirring of the precursor liquid and the exchange of heat. In this example, the inside diameter of the container 860 is 10 mm, the outside diameter of the cooling head is 9.5 mm and the useful volume of the chamber is 100 $mm^3$.

FIG. 9 shows cross-sectional views of a plurality of embodiments of containers according to the invention. The arrow X represents the direction of the incident beam. The arrow X also indicates the position of the thin wall. The cross sections are limited to the facial segment of the solid bodies so as to facilitate the representation of the thin walls.

The container 901, which has symmetry of revolution, is cylindrical and has an upper end of conical shape, is one of the preferred embodiments of the invention. The container 902, which has a symmetry of revolution, has two open ends, both of which are of conical shape. The containers 903 and 904 are similar to the container 901, except that they have an open end with a flat edge and an open end with a cylindrical edge, respectively. The container 905 is similar to the container 901, except that it has a "barrel" shape.

The container 906 is similar to the container 901, except that it has a one-sheet-hyperboloid shape.

The container 907 is similar to the container 901, except that it has a thin wall in the closed end. It thus allows an axial penetration of the beam.

The container 908, in contrast to the other containers shown, does not have symmetry of revolution, but a square or rectangular cross section, the thin wall possibly extending over a portion of two or three faces. This container is also shown in semi-isometric perspective. The container 910 is similar to the container 901, except that it has a larger diameter (for example 50 mm) and a flat bottom.

The container 909 is similar to the container 910, except that the thin portion is arranged in a ring on the flat bottom and allows an axial penetration of the beam. This container may advantageously be used in an external target, in which the incident beam is parallel to the axis of rotation, as shown by the arrow X.

In case of use as an external target, the targets 901 to 907 may be placed such that the beam penetrates into the target radially.

Advantages of the Invention

The container 100 according to the invention has the advantage of being of integral construction, i.e. of not requiring assembling means or working, mounting or demounting means. The thin fraction 130 of the container 100 forms as it were a window integrated into the container 100. The target and the container 100 according to the invention may be easily demounted and remounted. The operator may act rapidly and may therefore limit his exposure to radiation. The container of the invention requires little material. It is therefore inexpensive and creates little waste when it must be scrapped. The target assembly according to the invention may if needs be serve as a beam stop, for example during the setup of an accelerator.

The present invention has been described with reference to specific embodiments, which have been given purely by way a of illustration and which must not be considered to be limiting. Generally, it will appear obvious to those skilled in the art that the present invention is not limited to the examples illustrated and/or described above. The presence of reference numbers in the drawings must not be considered to be limiting, including when these numbers are indicated in the claims. The use of the verbs "comprise", "contain", "include", or any other variant, and their conjugations, in no way excludes the presence of elements other than those mentioned. The use of the indefinite article "a", "an" or the definite article "the" to introduce an element does not exclude the presence of a plurality of these elements. The use of the words top/bottom lower/upper is to be understood as being relative to the orientation of the components shown in the drawings. Although the examples described relate to the production of $^{18}F$ by irradiation by a beam of protons of a target material containing $^{18}O$-enriched water, the invention may be applied to other liquid precursors, such as ordinary water $H_2{}^{16}O$, which produces $^{13}N$ during irradiation with protons, or gaseous precursors, such as $^{14}N_2$ to obtain $^{11}C$. It is also possible to apply the invention to pulverulent precursor materials or to powders in suspension in a liquid and forming slurries. Lastly, the invention is also applicable to the case of a precursor material such as $^{11}B_2O_3$, which produces $^{11}C$ by (p,n) reaction and forms $^{11}CO_2$ that may be collected. Other particles such as deuterons and alpha particles may be used. Likewise, the target according to the invention may be used with the chamber of the container at atmospheric pressure, or with the chamber placed under pressure.

The invention claimed is:

1. A container for producing radioisotopes by irradiation of a precursor material, the container comprising: a metal jacket of integral construction, the metal jacket having a symmetry of revolution about an axis, and having from top to bottom (i) an upper portion being open and having a conical shape, the opening of the cone being oriented upwards, (ii) a first cylindrical portion connected to the upper portion, (iii) a thin wall cylindrical section connected to the first cylindrical portion, (iv) a second cylindrical portion connected to the thin wall cylindrical section, and (v) a dome connected to the second cylindrical portion, the thin wall cylindrical section having a first thickness between 5 μm and 100 μm, the first and second cylindrical section and the dome having a second thickness larger than 100 μm.

2. The container as claimed in claim 1, wherein thin wall cylindrical section has an outside diameter between 4 mm and 100 mm.

3. The container as claimed in claim 1, wherein the container is at least partially made from at least one of nickel, titanium, niobium, tantalum, iron, chromium, cobalt or a stainless steel.

4. A method for obtaining a container as claimed in claim 1, the method comprising:

providing a matrix;

electrodepositing on the matrix a thickness of a metallic material, until a first thickness between 5 μm and 100 μm is obtained;

masking a fraction of a surface of the matrix;

electrodepositing on an unmasked section until a thickness larger than 100 μm is obtained;

removing the matrix; and obtaining the container as claimed in claim 1.

5. The method as claimed in claim 4, wherein the matrix is removed by dissolution.

6. A target assembly for producing radioisotopes, including:

a container as claimed in claim 1;

a holding tube including at one end a threaded portion; and a ring including a suitable interior thread, the holding tube and the ring being configured to encase the container.

7. The target assembly as claimed in claim 6, wherein the container has an end having a conical shape, a base of the cone being oriented toward an exterior of the container, the holding tube has a conical end congruent with the end of the container, and the ring has a conical end congruent with the end of the container.

8. The target assembly as claimed in claim 6, wherein the holding tube and the container are mounted so as to be able to rotate about an axis, and the target assembly includes a motor arranged to make the holding tube and the container rotate.

9. The target assembly as claimed claim 6, further including a cooling tube placed inside the container and arranged to allow a cooling liquid to flow.

10. The target assembly as claimed in claim 9, wherein the cooling tube includes a cooling head that has a recess on a portion of a periphery of the cooling head, the recess to give incident beam a longer path in a precursor liquid.

* * * * *